US008755541B2

(12) United States Patent
Liu et al.

(10) Patent No.: US 8,755,541 B2
(45) Date of Patent: Jun. 17, 2014

(54) MICROPHONE WITH PARASITIC CAPACITANCE CANCELATION

(75) Inventors: Fang Liu, Woburn, MA (US); Kuang L. Yang, Newton, MA (US)

(73) Assignee: Invensense, Inc., San Jose, CA (US)

( * ) Notice: Subject to any disclaimer, the term of this patent is extended or adjusted under 35 U.S.C. 154(b) by 140 days.

(21) Appl. No.: 13/609,872

(22) Filed: Sep. 11, 2012

(65) Prior Publication Data

US 2014/0072150 A1 Mar. 13, 2014

(51) Int. Cl.
*H04R 25/00* (2006.01)

(52) U.S. Cl.
USPC ..... 381/174; 381/175

(58) Field of Classification Search
USPC ..... 381/174, 175
See application file for complete search history.

(56) References Cited

U.S. PATENT DOCUMENTS

| | | | | |
|---|---|---|---|---|
| 7,888,840 | B2 * | 2/2011 | Shimaoka et al. | 310/309 |
| 2007/0025569 | A1 * | 2/2007 | Akino | 381/174 |
| 2013/0044899 | A1 * | 2/2013 | Barber et al. | 381/113 |

* cited by examiner

*Primary Examiner* — Davetta W Goins
*Assistant Examiner* — Amir Etesam
(74) *Attorney, Agent, or Firm* — Maryam Imam; IPxLaw Group LLP

(57) ABSTRACT

A microelectromechanical microphone and method of manufacturing the same are disclosed. The microphone has a moveable diaphragm and a fixed backplate that create a variable capacitance. A fixed anchor electrically coupled to the diaphragm has an electrode that measures the variable capacitance, but also measures an unwanted, additive, parasitic capacitance. Various embodiments include a reference electrode, manufactured in the same deposition layer as the diaphragm or anchor, that measures only the parasitic capacitance. A circuit is provided either on-chip or off-chip that subtracts the capacitance measured at the reference electrode from that measured at the anchor, thereby producing only the desired variable capacitance as output. Because the reference electrode is deposited at the same time as the diaphragm or anchor, only minimal changes are required to existing manufacturing techniques.

20 Claims, 7 Drawing Sheets

MICROPHONE WITH PARASITIC CAPACITANCE CANCELATION

TECHNICAL FIELD

The present invention relates to microphones and more particularly to controlling parasitic capacitance in MEMS microphones.

BACKGROUND ART

Microelectromechanical systems (MEMS) microphones are widely used in voice communications, hearing-aid devices, and noise and vibration control applications. Various micromachining technology has been used to design and fabricate various MEMS microphones. Due to its high sensitivity, high signal-to-noise ratio (SNR), and long-term stability performance, the capacitive microphone is a very desirable and widely used type of microphone.

One significant limiting factor to the sensitivity of a MEMS microphone, however, is parasitic capacitance between the backplate and diaphragm of the microphone. Much of the research and development on solving this problem has focused on software calibration methods, including noise-reduction algorithms, and second-order directional microphones. Undesirably, those approaches require significant complexity and power. Accordingly, these solutions often increase overall cost of the ultimate device. When used in applications with limited power supplies (e.g., in hearing instruments, which often have very small batteries), these solutions reduce battery lifetime.

SUMMARY OF ILLUSTRATED EMBODIMENTS

Illustrative embodiments significantly improve MEMS microphone performance by substantially eliminating parasitic capacitance from the ultimate output signal. To that end, various embodiments form a second capacitor within the MEMS microphone. This second capacitor forms a reference capacitance that is substantially equal to the anticipated parasitic capacitance. Accordingly, circuitry uses this reference capacitance to remove the parasitic capacitance, thus producing the intended signal with no more than a negligible amount of noise. Details of illustrative embodiments are discussed below.

In accordance with a first embodiment of the invention, a MEMS microphone has a diaphragm, a backplate, a sensor, a reference electrode, and a circuit. The diaphragm is moveably coupled with an anchor, and the anchor is fixedly coupled to a substrate. The backplate is separated from the diaphragm by a dielectric fluid, and is fixedly coupled to the anchor by a dielectric solid. There is a first capacitance between the backplate and the diaphragm, and a second capacitance between the backplate and the anchor. The sensor measures a capacitance between the backplate and the diaphragm. This capacitance is substantially equal to the sum of the first capacitance and the second capacitance. The reference electrode is embedded within the dielectric solid. There is a third capacitance between the reference electrode and the backplate that is substantially the same as the second capacitance. The circuit subtracts the third capacitance from the capacitance measured by the sensor to produce an output capacitance that is substantially the same as the first capacitance.

The substrate may be a bulk silicon wafer. The diaphragm may be polysilicon. The backplate may be crystalline silicon. The microphone itself may be formed from a silicon-on-insulator (SOI) wafer. The dielectric fluid may be air. The diaphragm and the reference electrode may be fabricated from a single deposition layer.

In accordance with a second embodiment of the invention, a MEMS microphone has a backplate, an anchor, a diaphragm, a reference capacitor, and a circuit. The backplate and the anchor produce a parasitic capacitance. The diaphragm is movably secured to the anchor and spaced from the backplate, so that the diaphragm and backplate form a variable capacitor having a primary capacitance. The reference capacitor has a reference capacitance that is substantially equal to the parasitic capacitance. The circuit has an input that receives the primary capacitance, parasitic capacitance, and the reference capacitance. The circuit is configured to subtract the parasitic capacitance from the primary capacitance and the parasitic capacitance to produce an output capacitance substantially equal to the primary capacitance.

The MEMS microphone system of the second embodiment may have a first die and a second die, the first die including the variable capacitor and reference capacitor, the second die including the circuit, the first and second die being in electrical communication. Or, it may include a package containing the variable capacitor, the reference capacitor, and the circuit. The variable capacitor, reference capacitor, and circuit may be on a single die. The reference capacitor may include a reference electrode spaced from the backplate within a layered structure, the anchor and reference electrode being formed from the same material and being in the same layer within the layered structure.

The circuit may have a subtractor. A first subtractor input is electrically connected with the variable capacitor and the parasitic capacitance for receiving the sum of the primary capacitance and the parasitic capacitance. A second subtractor input is electrically connected with the reference capacitor for receiving the reference capacitance. The subtractor is configured to subtract the sum of the primary capacitance and parasitic capacitance from the reference capacitance.

The anchor may be formed from a given material, the reference capacitor comprising a reference electrode spaced from the backplate, the reference electrode being formed from the given material and being at least partly co-planar with the anchor. If so, the given material may be polysilicon.

There is also provided a method of producing a MEMS microphone system. The method begins by forming a diaphragm and a reference electrode on a base set of layers, wherein the diaphragm and reference electrode are formed at substantially the same time from a given material. Next, a sacrificial layer is formed on the given material. Then, a backplate and anchor are formed, and are spaced from the diaphragm and the reference electrode by the sacrificial layer. The method next requires removing the sacrificial layer between the backplate and diaphragm. The reference electrode and backplate form a fixed reference capacitance, the backplate and diaphragm form a variable capacitance, and the backplate produces a parasitic capacitance within the anchor. The method concludes with providing a circuit with an input that receives the variable capacitance, the parasitic capacitance, and the reference capacitance, the circuit being configured to subtract the reference capacitance from the sum of the variable capacitance and the parasitic capacitance to produce an output capacitance substantially equal to the variable capacitance.

The method may include mounting the formed components and the circuit in a package. Forming the reference electrode and forming the anchor may include depositing the given material onto the base set of layers. If so, a related method further includes micromachining the given layer to physically separate the reference electrode from the anchor.

In a second related method, forming a diaphragm and forming a backplate comprises forming a diaphragm and forming a backplate on a first die, further wherein providing a circuit comprises providing a circuit on a second die. The second related method further comprises electrically connecting the circuit with the backplate.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

Illustrative embodiments significantly improve MEMS microphone performance by substantially eliminating parasitic capacitance from the ultimate output signal. To that end, various embodiments form a second capacitor within the MEMS microphone. This second capacitor forms a reference capacitance that is substantially equal to the anticipated parasitic capacitance. Accordingly, circuitry uses this reference capacitance to remove the parasitic capacitance, thus producing the intended signal with no more than a negligible amount of noise. Details of illustrative embodiments are discussed below.

Figure 1A:
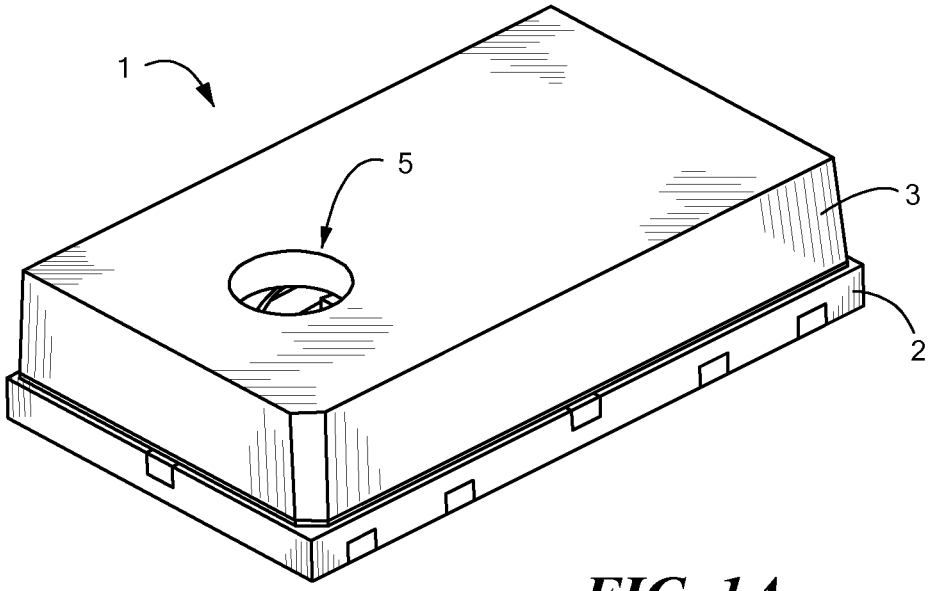
FIG. 1A schematically shows a perspective view of a packaged microphone that may be configured in accordance with illustrative embodiments of the invention.

FIG. 1A schematically shows a top, perspective view of a packaged microphone 1 that may be configured in accordance with illustrative embodiments of the invention. In a corresponding manner, FIG. 1B schematically shows a bottom, perspective view of the same packaged microphone 1.

The microphone 1 shown in those figures has a package base 2 that, together with a corresponding lid 3, forms an interior chamber containing a MEMS microphone die or chip 10 (discussed below, see FIGS. 1C and 2-4) and other components to effectuate the underling functionality (e.g., an application specific integrated circuit). The lid 3 in this embodiment is a cavity-type lid, which has four walls extending generally orthogonally from a top, interior face to form a cavity. The lid 3 secures to the top face of the substantially flat package base 2 to form the interior chamber. In illustrative embodiments, the lid is formed from a conductive material and electrically connected with the base 2 to form a shield against electromagnetic interference ("EMI"). Accordingly, among other things, the lid may be formed from metal, plastic coating with a metal layer, or plastic impregnated with conductive particles.

The lid 3 also has an audio input port 5 that enables ingress of audio signals into the chamber. In alternative embodiments, however, the audio port 5 is at another location, such as through the package base 2, or through one of the side walls of the lid 3. Audio signals entering the interior chamber interact with the microphone chip 10 to produce an electrical signal that, with additional (exterior) components (e.g., a speaker and accompanying circuitry), produce an output audible signal corresponding to the input audible signal.

Figure 1B:
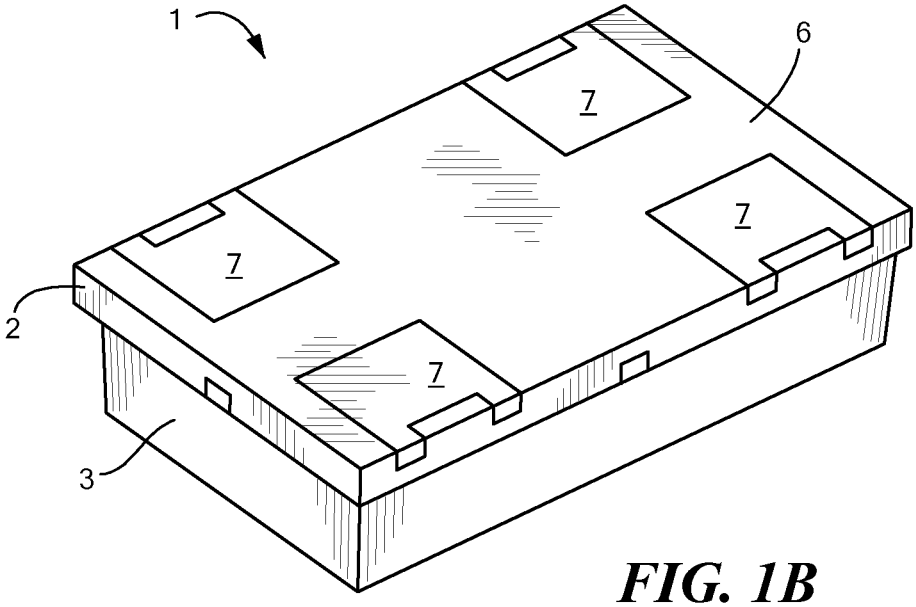
FIG. 1B schematically shows a bottom view of the packaged microphone shown in FIG. 1A.

FIG. 1B shows the bottom face 6 of the package base 2, which has a number of contacts 7 for electrically (and physically, in many anticipated uses) connecting the microphone with a larger substrate, such as a printed circuit board or other electrical interconnect apparatus. The packaged microphone 1 may be used in any of a wide variety of applications. For example, the packaged microphone 1 may be used with mobile telephones, land-line telephones, computer devices, video games, biometric security systems, two-way radios, public announcement systems, hearing instruments, and other devices that transduce signals. In fact, it is anticipated that the packaged microphone 1 could be used as a speaker to produce audible signals from electronic signals.

In illustrative embodiments, the package base 2 is a premolded, leadframe-type package (also referred to as a "premolded package"). Alternatively, among other things, the base 2 may comprise a substrate material, such as printed circuit board material (e.g., a laminate material such as BT, or FR-4), or a ceramic substrate.

Figure 1C:
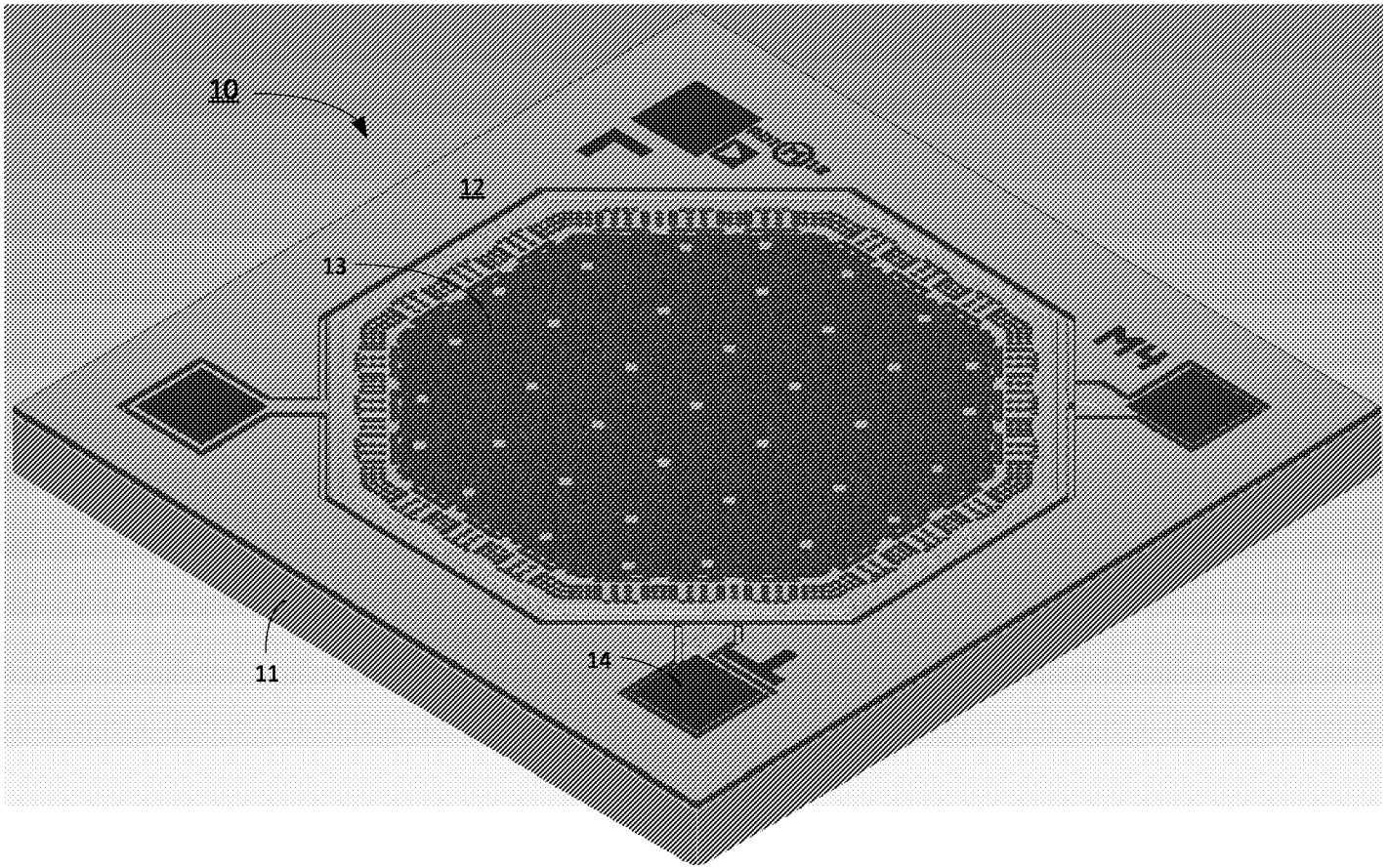
FIG. 1C is a three-dimensional view of a MEMS microphone structure in accordance with an embodiment of the present invention.

FIG. 1C is a three-dimensional view of a MEMS microphone system 10 that may be configured in accordance with various embodiments of the present invention. To that end, the MEMS microphone system 10 has a substrate 11 formed from a bulk silicon wafer, such as a single crystal silicon bulk wafer. Of course, other embodiments may use other wafers, such as a silicon-on-insulator (SOI) wafer. Various materials deposited, etched, and micromachined on the substrate 11 form microstructure that effectuates the ultimate function of the microphone system.

More specifically, as shown in FIGS. 1 and 2, the microphone system 10 has a backplate 13 formed from polysilicon. To facilitate operation, the backplate 13 has a plurality of through-hole apertures 25 ("backplate apertures") that lead to a backside cavity 24. Beneath this backplate 13 is a moveable diaphragm 21, also made by polysilicon deposition, for providing a variable capacitance with respect to the backplate 13. Thus, the microphone system 10 includes a static backplate 13 that supports and forms a variable capacitor with a moveable diaphragm 21. Also visible in FIG. 1 are four metallic readout contacts 14 for electrically connecting the microphone to the contacts 7 on a package or chip carrier. It should be noted that the shapes and composition of these elements may be different for different applications.

Figure 2A:
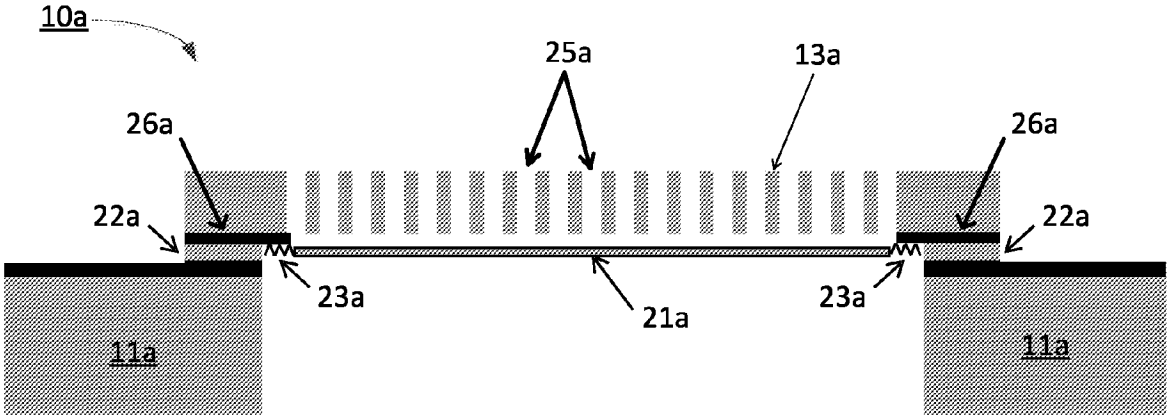
FIG. 2A is a schematic cross-section view of a MEMS microphone in which the backplate is above the diaphragm.

FIG. 2A is a schematic cross-section view of a MEMS microphone system 10*a* that may be modified to implement illustrative embodiments of the invention. This type of microphone system 10*a* positions its backplate 13*a* above the diaphragm 21*a*, as also shown in FIG. 1C. More specifically, the backplate 13*a* is considered to be "above" the diaphragm 21*a* in this Figure, primarily due to the orientation of the Figure, and due to the fact that the backplate 13*a* is not directly adjacent to the backside cavity 24*a* (discussed below). In this microphone system 10*a*, the backplate 13*a* and diaphragm 21*a* are typically both formed from deposition material on a bulk silicon substrate 11*a*. A diaphragm 21*a* is movably coupled to anchors 22*a* via springs 23*a* above the backside cavity 24*a*. The anchors 22*a* themselves are fixedly coupled to the substrate 11*a*, thereby providing mechanical stability. The backplate 13*a* is separated from the diaphragm 21*a* by a dielectric fluid (such as air) that fills the backside cavity 24*a* and the backplate apertures 25*a*. The backplate 13*a* is fixedly coupled to the anchor 22*a* by a dielectric solid 26*a*. The backplate 13*a* and diaphragm 21*a* also form the above noted variable capacitance that changes in proportion to the movement of the diaphragm 21*a*. Because the diaphragm 21*a* moves in proportion to the pressure existing in the dielectric fluid, the variable capacitance between the backplate 13*a* and the diaphragm 21*a* is proportional to the pressure in the fluid. That pressure may be caused by an acoustic signal, such as a person's voice entering through audio input port 5. Undesirably, a parasitic capacitance also exists between the backplate 13*a* and the anchor 22*a*, through the dielectric solid 26*a*. Remedies for addressing this unwanted capacitance, in accordance with various embodiments of the invention, are discussed in detail below.

Figure 2B:
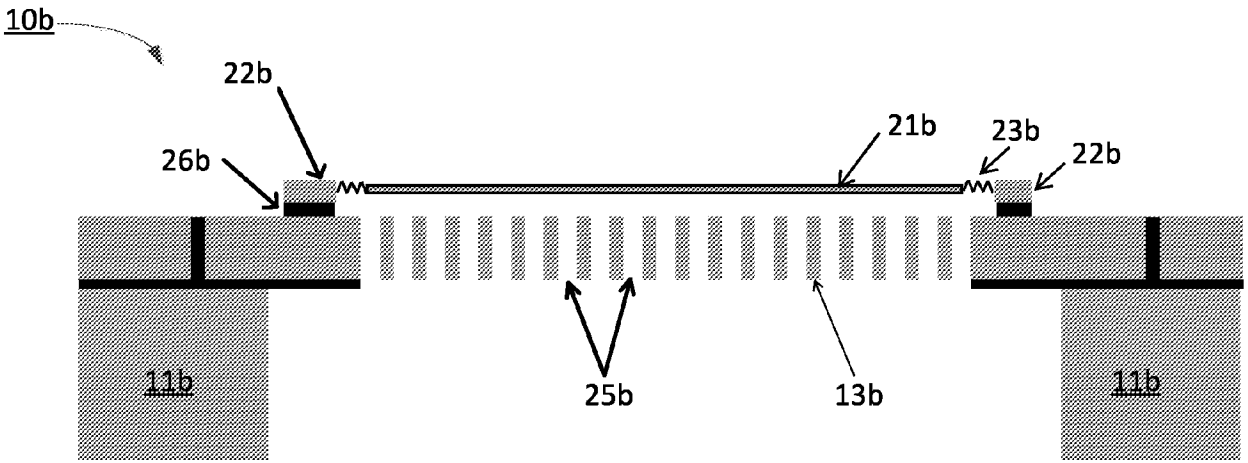
FIG. 2B is a schematic cross-section view of an alternate MEMS microphone in which the backplate is below the diaphragm.

FIG. 2B is a schematic cross-section view of another MEMS microphone 10*b* that may be modified to implement illustrative embodiments of the invention. Unlike the MEMS microphone 10*a* in FIG. 2A, this MEMS microphone 10*b* positions its backplate 13*b* below the diaphragm 21*b*. Specifically, the backplate 13*b* in this embodiment is formed from a layer of single crystal silicon (e.g., the top layer of a silicon-on-insulator wafer 11*b*), while the diaphragm 21*b* is formed from a deposited material, such as deposited polysilicon. The diaphragm 21*b* is movably coupled to anchors 22*b* via springs 23*b* above the backplate 13*b*. In this configuration, the backside cavity 24*b* is directly under the backplate 13*b*. To facilitate operation, the backplate 13*b* has backplate apertures 25*b* to reduce the pressure differential between it and the diaphragm 21*b*. The anchors 22*b* are fixedly coupled to the substrate 11*b* via the backplate 13*b* through a dielectric solid 26*b*. Various embodiments of the invention may use other types of materials and other micromachining processes and configurations to form the backplate and the diaphragm.

As known by those skilled in the art, a diaphragm 21 and a backplate 13 constitute the plates of a variable capacitor whose capacitance changes when an acoustic wave hits the diaphragm 21. Such waves may contact the microphone 10 from any direction. On-chip or off-chip circuitry receives and converts this changing capacitance, for example using the contacts 14 of FIG. 1C or the contacts 7 of FIG. 1B, into electrical signals that can be further processed. Such readout circuitry is discussed in more detail below in connection with FIG. 5.

To measure the microphone capacitance, it is difficult to attach a reliable electrical sensor directly to the moving diaphragm 21. Instead, illustrative embodiments electrically connect sensors to the anchor 22 and the backplate 13 to measure a capacitance between the diaphragm 21 and the backplate 13. However, as noted above, a second, parasitic capacitance exists between the anchor 22 and the backplate 13, due to the presence of the dielectric solid 26. This parasitic capacitance may be modeled as a parasitic capacitor. Thus, the sensor described above actually measures two capacitances: a variable capacitance between the diaphragm 21 and the backplate 13, and a capacitance between the anchor 22 and the backplate 13, i.e., the parasitic capacitance.

Sensitivity to parasitic capacitance is a significant drawback of the voltage readout circuit of prior art microphones because the parasitic capacitance from the overlapping geometry of the backplate and the diaphragm decreases the sensitivity of the readout. In a microphone 10 with variable capacitance $C_M$, which is the capacitance between the diaphragm 21 and the fixed backplate 13, and a fixed parasitic capacitance $C_P$, which is the capacitance between the anchor 22 and the backplate 13, the total capacitance is equal to $C_M+C_P$. The sensitivity is proportional to $C_M/(C_M+C_P)$. In order to enhance sensitivity, $C_P$ must be reduced or eliminated.

Figure 3A:
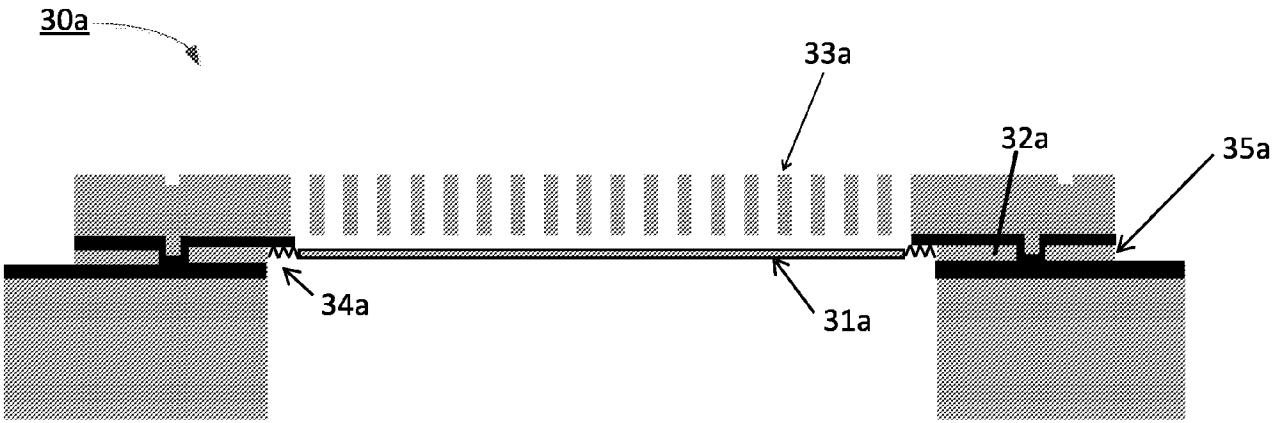
FIG. 3A is a schematic cross-section view of the microphone of FIG. 2A with an added reference electrode according to an embodiment of the invention.
Figure 3B:
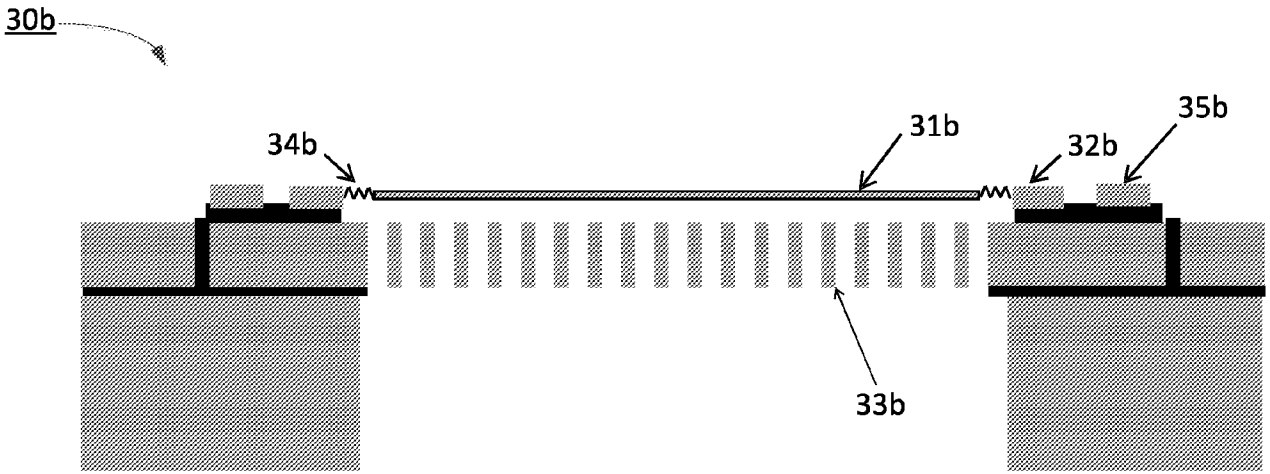
FIG. 3B is a schematic cross-section view of the microphone of FIG. 2B with an added reference electrode according to an embodiment of the invention.

Therefore, various embodiments of the invention form a reference capacitor having a capacitance that is substantially equal to the parasitic capacitance. FIGS. 3A and 3B are schematic cross-section views of microphones 30 similar to those of FIGS. 2A and 2B, but with a reference capacitor having a capacitance that are substantially equal to the parasitic capacitance. The embodiment of FIG. 3A has a diaphragm 31*a*, an anchor 32*a*, a backplate 33*a*, and a spring 34*a* as in prior art systems. However, in accordance with illustrative embodiments, a reference capacitor is formed in part from a reference electrode 35*a*. More specifically, the embodiment of FIG. 3A forms a reference capacitor between the reference electrode 35*a* and the backplate 33*a*.

In accordance with illustrative embodiments, the reference electrode and the anchor are manufactured so that the capacitance between each and the backplate is identical. For example, the reference electrode 35*a* may have the same material composition and geometrical dimensions as the anchor 32*a*, and both may be formed in the same layer to ensure substantially identical spacing between their respective electrodes. This may be achieved by forming the anchor 32*a* and the reference electrode 35*a* from a single deposited polysilicon layer. In this way, their thicknesses will be identical. The parasitic capacitance is known simply by knowing the physical composition and makeup of the anchor 32*a*. Accordingly, by appropriately photo patterning a later-deposited sacrificial layer, the lateral area of the reference electrode 35*a* can be designed to achieve a capacitance of $C_P$. In other words, micromachining processes may etch a single layer of polysilicon to ensure that both electrodes (the anchor electrode 32*a* of the parasitic capacitor and the reference electrode 35*a* of the reference capacitor) produce a substantially identical capacitance with regard to the backplate 33*a*.

In alternative embodiments, the processes may produce different types of capacitors and still maintain their substantially equal capacitance. For example, the widths of the respective electrodes 32*a*, 35*a* may be different for the two capacitors. In that case, the surface area of the reference electrode 35*a* may be enlarged or reduced, as appropriate, to ensure substantially identical capacitances. Accordingly, various embodiments may produce two electrodes 32*a*, 35*a* that are either substantially identical, or substantially different, yet still produce the same capacitances with respect to the backplate 33*a*.

Indeed, various embodiments apply to other configurations of MEMS microphones. For example, FIG. 3B is a schematic cross-section view of a microphone 30*b* with an added reference electrode 35*b* according to an embodiment of the invention. In a manner similar to FIG. 3(*a*), this figure shows the diaphragm 31*b*, anchor 32*b*, backplate 33*b*, and spring 34*b*. A reference electrode 35*b* is shown on top of the backplate, rather than below it, in accordance with the geometry of this embodiment.

Figure 4:
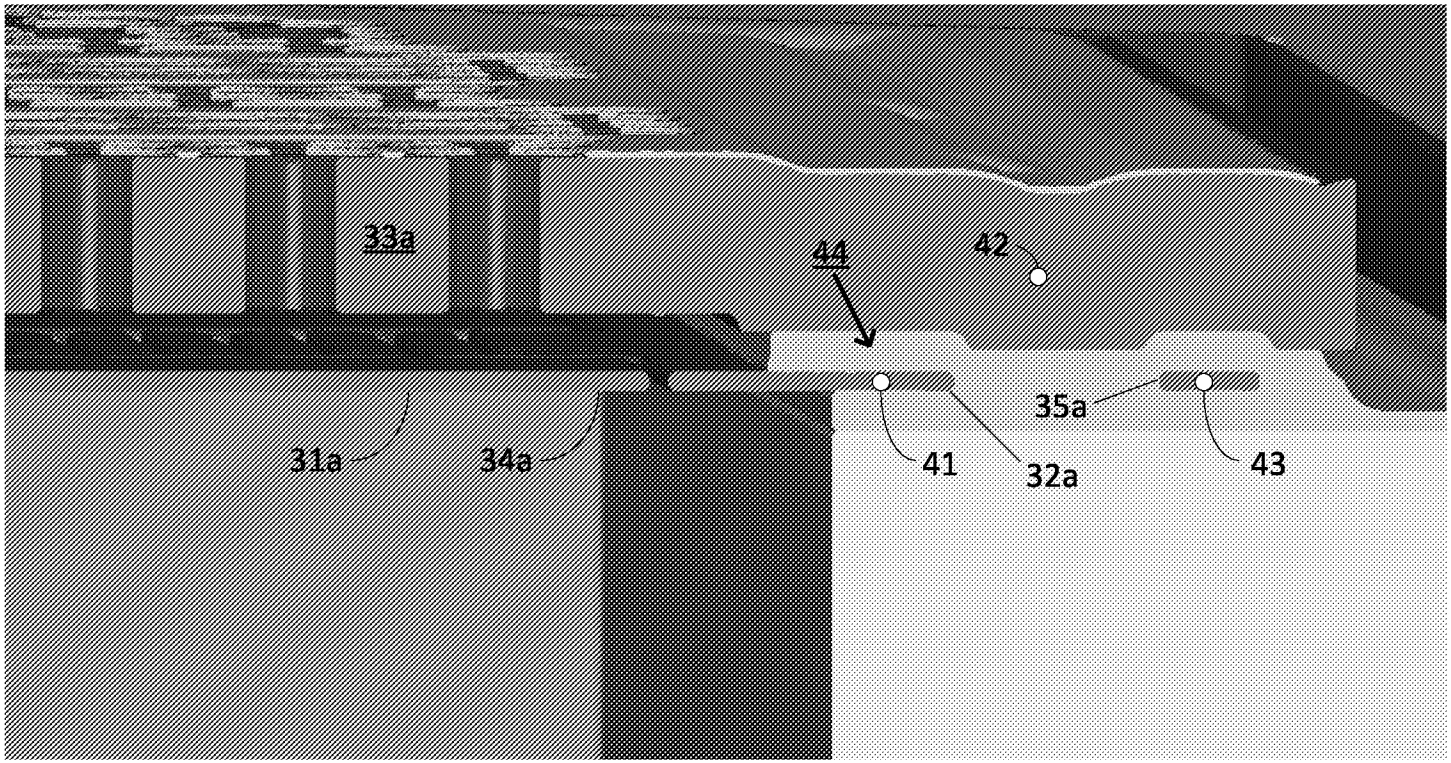
FIG. 4 shows an image of a MEMS microphone according to FIG. 3A.

FIG. 4 shows a schematic three-dimensional, cross-sectional view of the MEMS microphone 30*a*, with the backplate 33*a* on top of the diaphragm 31*a*. The reference electrode 35*a* is visible, and is made from the same polysilicon layer as the diaphragm 31*a*, anchor 32*a*, and spring 34*a*. The reference electrode 35*a* may be formed in the same plane as the anchor 32*a*. As discussed below, the backplate 33*a* was later deposited, and a sacrificial layer removed to give rise to a gap between the diaphragm 31*a* and the backplate 33*a*. Three electrical nodes are highlighted for reference purposes: a sensor node 41 in the material forming the diaphragm 31*a* and anchor 32*a*, a backplate node 42 in the material forming the backplate 33*a*, and a reference node 43 in the material forming the reference electrode 35*a*. Prior art microphones measure the capacitance between the sensor node 41 and backplate node 42, which is equal in large part to the variable capacitance between the diaphragm 31*a* and the backplate 33*a*. However, as explained above, those measurements also include the parasitic capacitance between the anchor 32*a* and the backplate 33*a* (i.e., from nodes 41 and 42), passing through the dielectric solid 44. In accordance with various embodiments of the present invention, this parasitic capacitance is substantially identical to that between the backplate 33*a* and the reference electrode 35*a*, as measured between the backplate node 42 and the reference node 43. By subtracting out this identical capacitance from the readout, $C_M$ (i.e., the desired output capacitance without parasitic capacitance) can be determined much more precisely than in the prior art.

Figure 5:
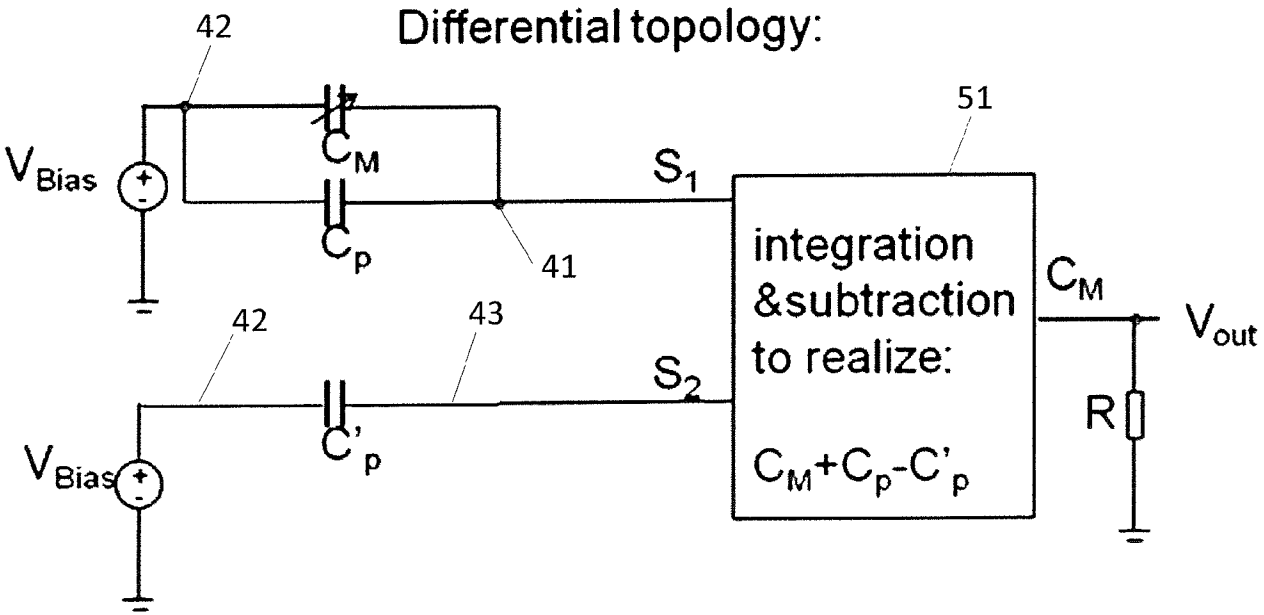
FIG. 5 shows a schematic diagram of a differential readout circuit topology that may be used in conjunction with an embodiment of the invention.

A differential circuit readout topology using the reference capacitance discussed above may be fabricated on the area surrounding the MEMS microphone 30. FIG. 5 shows a schematic diagram of the differential readout circuit topology. The electrical nodes 41, 42, 43 are labeled in this figure, with $C_M$ shown as a variable capacitance and $C_P$ shown as a fixed capacitance. The reference electrode has a capacitance of $C'_P$ that is identical to $C_P$. A bias voltage $V_{bias}$ is applied to the backplate, as is known in the art. The readout circuit receives two voltage signals $S_1$ and $S_2$ from the sensors to an output voltage $V_{out}$ that is proportional to $C_M+C_P-C'_P=C_M$. A resistor R is provided to normalize the output voltage.

In illustrative embodiments, the integration and subtraction block 51 of FIG. 5 is formed on the same die as the microphone itself. Alternative embodiments, however, may form some or all of that block on another chip. For example, the that functionality could be implemented by either discrete components, integrated circuits (e.g., within an application specific integrated circuit), or both.

It should be noted that the circuit of FIG. 5 is but one of any number of different circuits that may be used to remove the parasitic capacitance using the reference electrode. Those skilled in the art could develop any of a number of different circuits to accomplish this removal process. Discussion of that circuit thus is for exemplary purposes only.

Figure 6:
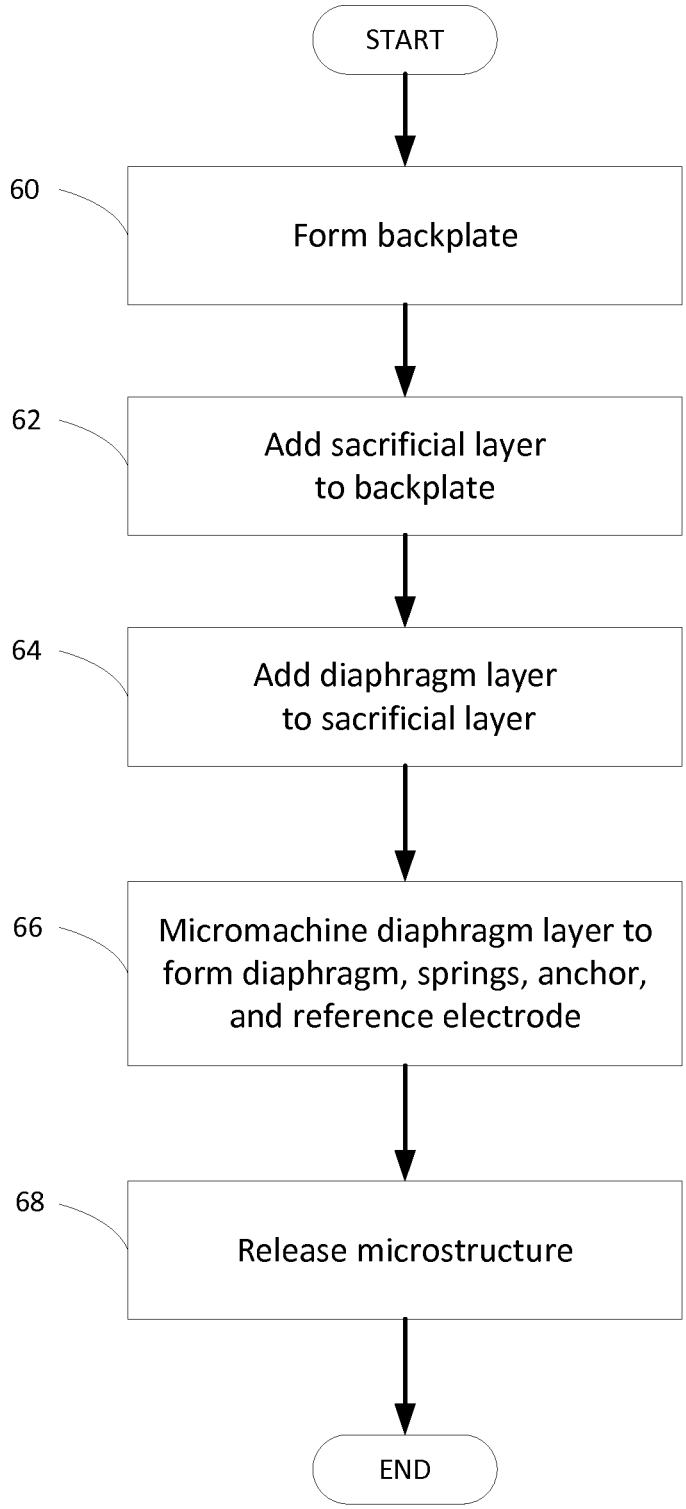
FIG. 6 shows a process of forming a microphone in accordance with illustrative embodiments of the invention.

FIG. 6 shows a process of forming the microphone of FIG. 3B in accordance with illustrative embodiments of the invention. This process can be applied to other microphone embodiments and thus, discussion of this specific embodiment of FIG. 3B is for exemplary purposes only. It should be noted that this process does not describe all steps required for forming the microphone. Instead, it shows various relevant steps for forming the microphone. Accordingly, some steps are not discussed for simplicity. See, for example, U.S. Pat. No. 7,449,356 for more information regarding a similar fabrication method, the disclosure of which is incorporated herein, in its entirety, by reference. Those skilled in the art can incorporate principles of the process in that incorporated patent into the process of FIG. 6.

The process begins at step 60, which forms the backplate 33*b*. To that end, the process applies conventional micromachining processes to the top layer of a silicon-on-insulator ("SOI") wafer. For example, the process may use photoresist masks to etch the backplate holes and other trenches within the top layer of the SOI wafer. Next, the process adds one or more sacrificial layers to the backplate (step 62). Among other things, the sacrificial layer can include an oxide that is either grown or deposited. This sacrificial layer will fill the through holes in the backplate and provide support for the next layer. Moreover, as noted in the incorporated patent, this sacrificial layer also can include a nitride lining layer, sacrificial polysilicon, and one or more oxide layers.

After forming the sacrificial layer(s), the process continues to step 64, which deposits the layer that ultimately forms the diaphragm 31*b*, anchor 32*b*, springs 34*b*, and reference electrode 35*b*. In illustrative embodiments, this layer is formed from polysilicon, although, like other layers, it can be formed from other materials suitable for the intended application. The process then continues to step 66, which forms the noted elements. Again, like the other steps, the process can implement conventional micromachining techniques, such as masking and etching using additive and subtractive steps.

Finally, the process concludes at step 68 by releasing the microstructure, i.e., releasing the diaphragm 31*b*. This essentially removes much or all of the sacrificial material between the springs 34*b*/diaphragm 31*b* and the backplate 33*b*. If the sacrificial layer is formed from an oxide alone, for example, then the structure may be exposed to an acid, such as hydrofluoric acid. If the microstructure also includes polysilicon, then other removal compositions may be used, such as xenon difluoride.

As noted above, additional steps are expected to produce a functioning microphone die. For example, there may be circuit fabrication steps, testing, dicing/sawing steps, and so on. The circuit fabrication step can form the subtraction block 51 of FIG. 5 on the same die, or on another die. After they are formed, conventional packaging processes may secure each microphone within a package as shown in FIGS. 1A and 1B. As noted, these packaging processes also may include other components, such as ASICs, to the package interior.

Illustrative embodiments therefore produce an output microphone signal that is substantially devoid of parasitic capacitance without requiring significant additional steps in the fabrication process. In other words, due to the fact that it is formed in the same steps as the anchor, the reference capacitor should add little, if any, additional time and expense to the process. Accordingly, use of the reference capacitor improves output performance with a negligible or no net cost to the ultimate microphone.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A microelectromechanical microphone comprising:

a diaphragm moveably coupled with an anchor, the anchor being fixedly coupled to a substrate; a backplate, separated from the diaphragm by a dielectric fluid, the backplate being fixedly coupled to the anchor by a dielectric solid, there being a first capacitance between the backplate and the diaphragm and a second capacitance between the backplate and the anchor; a sensor attached to the anchor, for measuring a capacitance between the backplate and the diaphragm, the measured capacitance being substantially equal to the sum of the first capacitance and the second capacitance; a reference electrode spaced from the backplate within a layered structure, the anchor and reference electrode being formed from the same material and being in the same layer within the layered structure wherein the reference electrode is embedded within the dielectric solid, there being a third capacitance between the reference electrode and the backplate that is substantially the same as the second capacitance; and a circuit that subtracts the third capacitance from the capacitance measured by the sensor to produce an output capacitance that is substantially the same as the first capacitance.

2. A microphone according to claim 1, wherein the substrate is a bulk silicon wafer.

3. A microphone according to claim 1, wherein the diaphragm comprises polysilicon.

4. A microphone according to claim 1, wherein the backplate comprises single crystal silicon.

5. A microphone according to claim 1 formed from an SOI wafer.

6. A microphone according to claim 1, wherein the dielectric fluid is air.

7. A microphone according to claim 1, wherein the diaphragm and the reference electrode comprise a single deposition layer.

8. A MEMS microphone system comprising:

a backplate; an anchor, the backplate and anchor producing a parasitic capacitance; a diaphragm movably secured to the anchor and spaced from the backplate, the diaphragm and backplate forming a variable capacitor, the variable capacitor having a primary capacitance; a reference capacitor spaced from the backplate within a layered structure, the anchor and reference capacitor being formed from the same material and being in the same layer within the layered structure wherein the reference capacitor is having a reference capacitance that is substantially equal to the parasitic capacitance; and a circuit having an input that receives the primary capacitance, parasitic capacitance, and the reference capacitance, the circuit being configured to subtract the parasitic capacitance from the primary capacitance and the parasitic capacitance to produce an output capacitance substantially equal to the primary capacitance.

9. The MEMS microphone system as defined by claim 8, further comprising a first die and a second die, the first die including the variable capacitor and reference capacitor, the second die including the circuit, the first and die being in electrical communication.

10. The MEMS microphone system as defined by claim 8, further including a package containing the variable capacitor, the reference capacitor, and the circuit.

11. The MEMS microphone system as defined by claim 8, wherein the variable capacitor, reference capacitor, and circuit are on a single die.

12. The MEMS microphone system as defined by claim 8, wherein the circuit comprises a subtractor having a first input electrically connected with the variable capacitor and the parasitic capacitance for receiving the sum of the primary capacitance and the parasitic capacitance, the subtractor having a second input electrically connected with the reference capacitor for receiving the reference capacitance, the subtractor being configured to subtract the sum of the primary capacitance and parasitic capacitance from the reference capacitance.

13. The MEMS microphone system as defined by claim 8, wherein the anchor is formed from a given material, the reference capacitor comprising a reference electrode spaced from the backplate, the reference electrode being formed from the given material and being at least partly co-planar with the anchor.

14. The MEMS microphone system as defined by claim 13, wherein the given material comprises polysilicon.

15. The MEMS microphone as defined by claim 8 wherein the reference capacitor comprises a reference electrode spaced from the backplate within a layered structure, the anchor and reference electrode being formed from the same material and being in the same layer within the layered structure.

16. A method of producing a MEMS microphone system, the method comprising:

forming a diaphragm and a reference electrode on a base set of layers, wherein the diaphragm and reference electrode are formed at substantially the same time from a given material;

forming a sacrificial layer on the given material;

forming a backplate and anchor that is spaced from the diaphragm and the reference electrode by the sacrificial layer;

removing the sacrificial layer between the backplate and diaphragm, wherein the reference electrode and backplate form a fixed reference capacitance, the backplate and diaphragm forming a variable capacitance, the backplate also producing a parasitic capacitance within the anchor; and providing a circuit with an input that receives the variable capacitance, the parasitic capacitance, and the reference capacitance, the circuit being configured to subtract the reference capacitance from the sum of the variable capacitance and the parasitic capacitance to produce an output capacitance substantially equal to the variable capacitance.

17. The method of producing as defined by claim 16 wherein forming the reference electrode and forming the anchor comprises depositing the given material onto the base set of layers.

18. The method of producing as defined by claim 17 further comprising micromachining to physically separate the reference electrode from the anchor.

19. The method of producing as defined by claim 17 wherein forming a diaphragm and forming a backplate comprises forming a diaphragm and forming a backplate on a first die, further wherein providing a circuit comprises providing a circuit on a second die, the method further comprising electrically connecting the circuit with the backplate.

20. The method of producing as defined by claim 16 further including mounting the formed components and the circuit in a package.

* * * * *